US006364059B1

(12) United States Patent
Wellton Persson

(10) Patent No.: US 6,364,059 B1
(45) Date of Patent: Apr. 2, 2002

(54) LUBRICATING SYSTEM, PREFERABLY FOR REFRIGERATING MACHINERY AND COMPRISING A PITOT TUBE PUMP

(76) Inventor: Claes Lorentz Uno Wellton Persson, Sveavagen 118, Stockholm (SE), S-133 50

( * ) Notice: Subject to any disclaimer, the term of this patent is extended or adjusted under 35 U.S.C. 154(b) by 0 days.

(21) Appl. No.: 09/509,540

(22) PCT Filed: Sep. 30, 1998

(86) PCT No.: PCT/SE98/01757

§ 371 Date: Apr. 10, 2000

§ 102(e) Date: Apr. 10, 2000

(87) PCT Pub. No.: WO99/19627

PCT Pub. Date: Apr. 22, 1999

(30) Foreign Application Priority Data

Oct. 13, 1997 (SE) ..... 9703722

(51) Int. Cl.[7] ..... F01M 1/00
(52) U.S. Cl. ..... 184/6.16; 184/31; 415/88
(58) Field of Search ..... 184/6.16, 31, 43; 415/88, 89

(56) References Cited

U.S. PATENT DOCUMENTS 2,025,187 A * 12/1935 Werner et al. ..... 184/6
3,977,810 A * 8/1976 Erickson et al. ..... 415/89
3,986,852 A 10/1976 Doerrer et al. ..... 62/467

FOREIGN PATENT DOCUMENTS

EP 0 345 919 A2 * 12/1989

* cited by examiner

*Primary Examiner*—David Fenstermacher
(74) *Attorney, Agent, or Firm*—Jacobson Holman, PLLC

(57) ABSTRACT

A lubricating system, preferably for smaller refrigerating machinery of piston compressor type (1, 2, 3) having a substantially vertically extending drive shaft (4). A disc-shaped member (11) is arranged adjacent to the lower part of the drive shaft (4) to be rotated by the rotary movement of the drive shaft (4), arranged having oil transferring means (12; 20, 20', 20") communicating with oil in an underlying oil reservoir (10). Said oil transferring means (12; 20, 20', 20") will during a rotary movement transfer oil from the oil reservoir (10) to the upper plane of the disc-shaped member (11), and a tubular pipe (14), having its lower open part (15) open against the rotary direction at the peripheral part of the disc-shaped member (11), moves in the manner of a Pitot pipe pump oil via the tubular pipe (14) from the disc-shaped member (11) for lubrication of the piston compressor (1, 2, 3). The lower portion of the drive shaft (4) can be arranged with a downwardly open conically reduced tubular member (9), which at a high rotary speed collects and transfers oil through a channel taken up in the drive shaft (4) for lubrication of the piston compressor.

17 Claims, 5 Drawing Sheets

LUBRICATING SYSTEM, PREFERABLY FOR REFRIGERATING MACHINERY AND COMPRISING A PITOT TUBE PUMP

The present invention relates to a lubricating system, preferably for smaller refrigerating machinery of piston compressor type having a driven crankshaft with a substantially vertical extension.

Refrigerators and freezers use to a large extent compressors driven by a small electric motor and with a vertically extending driven crankshaft, normally having a rotary speed in the region of 2800–3400 revolutions/minute. The lubricating system for such compressors has for a long period of time been optimized for such a rotary speed, based on that a vertically extending crankshaft is made hollow, and with a lower conically reduced and downwardly open member, having the opening lowered into oil existing in the lower part of the compressor housing. When the crankshaft is rotating, the oil existing in the lower part of the conical member is thrown outwards/upwards by means of centrifugal force within the conical member. Since oil continuously is being supplied from below, the oil forced outwards/upwards within the conical member due to the rotation of the crankshaft will successively "climb upwards" within the hollow crankshaft, i.e. also on the cylindrical portion located above the conical means. The force whereby the oil is moved in direction upwards within the crankshaft is based on the conicity of the lower portion and by the rotary speed. However, the conicity is restricted by the outside dimensions given to the crankshaft, and crankshafts as used today have dimensions in the region of 20 mm. As a result, the lowest rotary speed (minimum number of revolutions) is approximately 1800 revolutions/minute.

A major disadvantage related to the above mentioned known lubricating systems is that the lubricating system has been optimized for a predetermined rotary speed, and that a reduction of rotary speed, intended to increase system efficiency, is not allowed. Practical tests have shown that a compressor having the above type of lubricating system and with a calculated length of service of 15 years at a rotary speed exceeding 2000 revolutions/minute receive a length of service reduced to only a few hours already when the rotary speed is reduced to 1500–1600 revolutions/minute.

The object of the present invention is to disclose a lubricating system facilitating totally acceptable lubrication at considerably lower rotary speed than what has previously been regarded as possible, and thereby meeting the demands of today related to increased system efficiency, i.e. a compressor cycle with reduced speed, which also may alternate with a compressor cycle having increased rotary speed. A compressor system according to the present invention also meets remaining requirements of such a lubricating system, namely that same should be accomplished at lowest possible cost, that it should include few components, and that it should have a design securing a long period of service. Continuous use of low rotary speed results in up to 20% increased system efficiency, something which obviously is most desirable.

The lubricating system according to the present invention is preferably intended for smaller refrigerating machinery of piston compressor type having a substantially vertically extending drive shaft, and it is mainly characterized in that a preferably substantially disc shaped member is arranged adjacent to the lower part of the drive shaft to be rotated by the rotary movement of the drive shaft and having a substantially in direction upwards extending peripheral edge portion, also including one or a number of oil transferring means for communication with oil in an underlying oil reservoir, said oil transferring means during a rotary movement being arranged to collect and transfer oil from the underlying oil reservoir to the upper plane of the preferably substantially disc shaped member, a tubular pipe being arranged having its lower open part directed in an opposed direction to the rotary direction of the preferably substantially disc shaped member adjacent to the peripheral part of same arranged to transfer oil as a Pitot pipe pump via the tubular pipe from the preferably substantially disc shaped member for lubrication of the piston compressor. The lower portion of the drive shaft may advantageously include a downwardly open conically reduced tubular member, extending down below the oil level in the underlying oil reservoir, at a high rotary speed being arranged with its internal surface, due to influence from centrifugal force, to collect and transfer oil through a channel taken up in the drive shaft for lubrication of the piston compressor, wherein pump action achieved by the conically reduced tubular member is arranged to lower the oil level in the underlying oil reservoir to a level at which the oil transferring means no longer take up contact with the oil in the underlying oil reservoir and/or that the oil transferring ability of said means is substantially completely reduced at high rotary speed.

A number of non-restricting examples of embodiments of a lubricating system according to the present invention will be more fully described below with reference to the accompanying drawings, in which.

Figure 1:
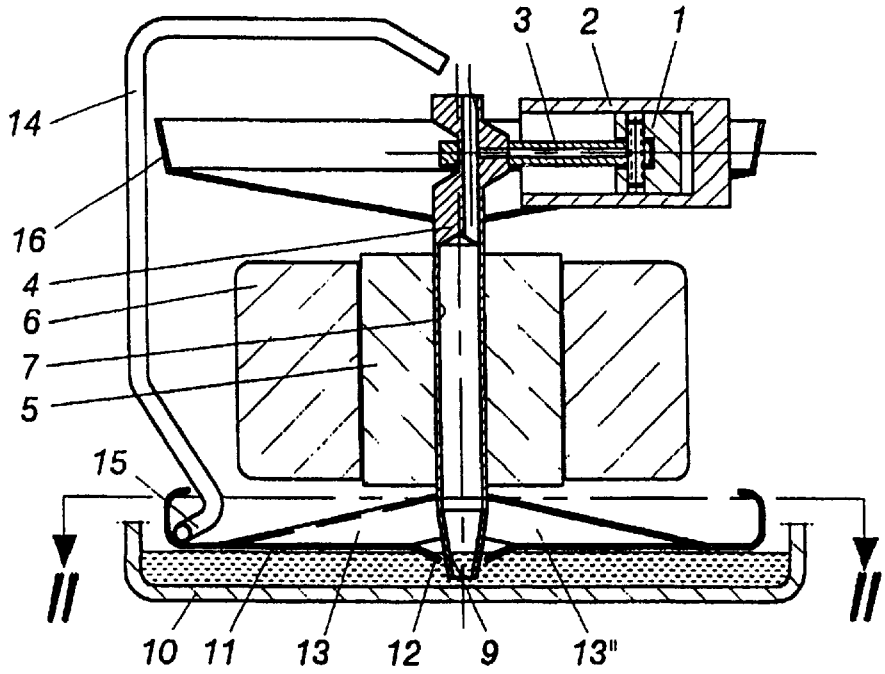
FIG. 1 is a cross-sectional side view of an example of an embodiment of a compressor having a lubricating system according to the invention (shown in a stationary position)
Figure 2:
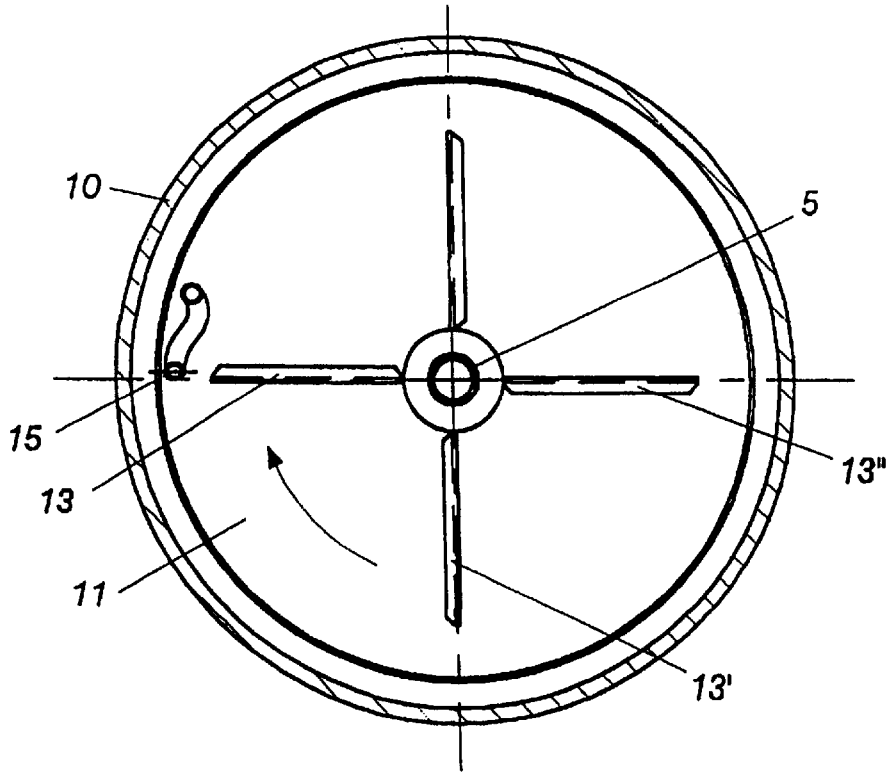
FIG. 2 shows a view at the line II—II in FIG. 1.

With reference to the example of an embodiment of a lubricating system according to the invention shown in FIGS. 1 and 2, a piston compressor is schematically shown comprising a piston 1 and an associated piston cylinder 2, the piston 1 being joined to a drive shaft 4 having a crank by means of a connecting rod 3.

The drive shaft 4 extends substantially vertical, having its central portion attached to a rotor 5, which is surrounded by a stator windings 6, the rotor 5 and the stator windings 6 jointly forming an electric motor. The drive shaft 4 has a central drilled hole 7 extending from its lower portion, communicating with a radially displaced hole 8 through the upper portion including the crank. Furthermore, a downwardly conically reduced member 9 is attached to the lower portion of the drive shaft 4, the conically reduced member 9 extending down into a reservoir 10 with oil (which preferably comprises of the lower part of a not shown surrounding compressor housing).

With regard to what is described above, shown example of an embodiment comprises of a conventional and known solution, adapted to a compressor driven with a rotary speed in the region of 1800 revolutions/minute and preferably an even higher rotary speed.

In order to facilitate adequate lubrication also at lower rotary speed, shown example of an embodiment also comprises a disc shaped member 11 fixed to the lower portion of the drive shaft 4, having the outer peripheral portion bent upwards and inwards. Furthermore, said disc shaped member 11 is arranged with a centrally located hole 12, having the edge portion extending inclined downwards, whereby a surrounding opening is defined around the conically reduced member 9. The top surface of the disc shaped member 11 is also advantageously as shown joined to the drive shaft 4 by means of a number of radially extending supporting members 13, 13', 13", which, as described later, improve the operation.

Inside the folded over outer portion of the disc shaped member 11 is a pipe 14 located, having a lower opening 15 directed against the rotary direction of the disc shaped member 11. The pipe 14 is fixed to, for example, a surrounding compressor housing or the stator windings 6 of the electric motor, thereby forming a Pitot pipe pump. The open upper free end portion of the pipe 14 can, for example, be arranged directed towards the members requiring lubrication. An oil collecting container 16 is also shown fixed in a plane below the upper free portion of the pipe 14, from which oil is returned to the lower oil reservoir 10.

Figure 3:
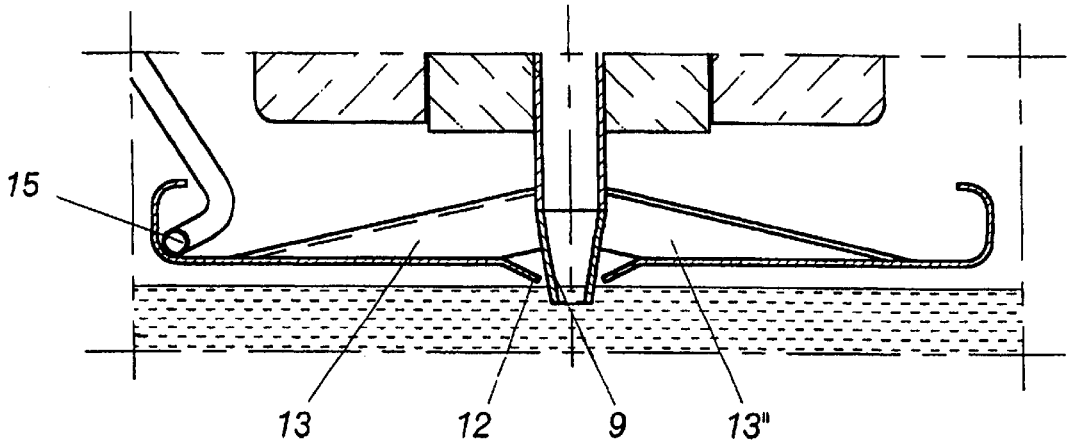
FIG. 3 shows a side view corresponding to the lower portion of FIG. 1, intended to illustrate the operation of the lubricating system when the compressor is driven with a high rotational speed.

When the compressor is driven with a high rotary speed, lubrication is performed in a known fashion, i.e. the inside surface of the downwardly open and conically reduced member 9 drives through influence from centrifugal force the oil existing within said member 9 in direction upwards, and oil is continuously available due to supply from the lower reservoir 10. As a result of the fact that oil is being continuously fed upwards within the drive shaft 4, the oil level is lowered in the lower oil reservoir 10, and the downwardly extending edge portion of the centrally located hole 12 in the rotating disc shaped member 11 will thus loose contact with the oil in the lower reservoir 10. This situation is schematically illustrated in FIG. 3. The above mentioned lowering of the oil level in the lower oil reservoir 10 is advantageously emphasized by letting the upper oil collecting container 16 serve as a reservoir, from which oil can be allowed to return to the lower oil reservoir 10 via, for example, a radially extending channel in the drive shaft, a separate return flow pipe (not shown), or along the internal surface of a surrounding compressor housing.

Should the rotary speed of the drive motor be reduced, the above described lubricating system stops operating, i.e. the internal surface of the conically reduced member 9 can no longer due to influence from centrifugal force drive oil in direction upwards within the drive shaft 4. Any lubricating effect is thus no longer accomplished by the existence of the downwardly conically reduced member, and as a result, the oil level in the lower reservoir 10 becomes higher, whereby previously mentioned downwardly bent edge portion adjacent to the centrally located hole 12 receives contact with the oil.

Since this preferably substantially inclined edge portion has a relatively restricted length extension, the oil will be "lifted", also at a considerably reduced rotary speed, to the upper plane of the rotating disc shaped member 11, and same will also by influence from centrifugal force be driven outwardly towards the upwards and inwards bent edge portion of said disc shaped member 11.

The movement of the oil along the upper plane of the disc shaped member 11 towards the bent over outer edge portion is emphasized by the radially extending supporting members 13, 13', 13" joined to said plane, which, as shown, also can be arranged having the upper portion bent over and extending against the rotary direction. As an example of an alternative or additional step to improve the movement of the oil along the upper plane of the disc shaped member 11, said disc shaped member 11 may also be arranged or shaped with other types of substantially radially extending means, e.g. upwards or downwards directed longitudinally extending embossments.

Figure 4:
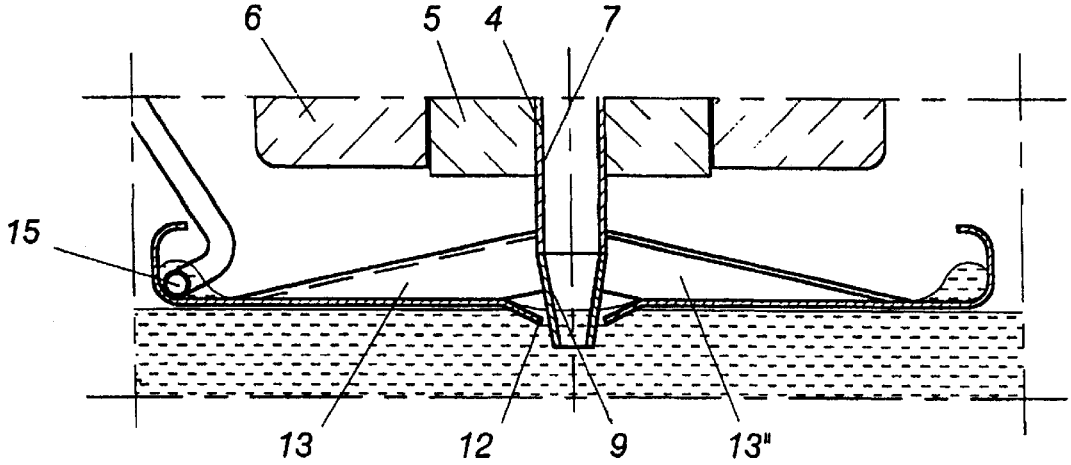
FIG. 4 shows a side view corresponding to FIG. 3, intended to illustrate the operation of the lubricating system when the compressor is driven with a low rotational speed.

The oil which is hereby supplied to the peripheral part of the disc shaped member 11 will be supplied to the lower opening 15 of the pipe 14, open in direction against the rotary direction, and the pipe 14, operating corresponding to a Pitot pipe pump, will transfer the oil to a point adjacent to the upper portion of the drive shaft 4, and being supplied via an existing hole 8 to the movable parts of the compressor for lubrication of same. The operation of the lubricating system at a low rotary speed is schematically illustrated in FIG. 4.

In order to further secure that oil is being supplied to and collected by the outer peripheral portion of the disc shaped member 11, said member can also be arranged having a slightly downwardly inclined surface in direction outwards, and the oil collecting edge portion adjacent to the centrally located hole 12 can also be arranged having spaced upwardly or downwardly directed means, arranged to further improve the oil collecting ability, e.g. substantially radially and upwardly extending embossments, which also can be arranged somewhat "inclined" in relation to the rotary direction, and having the lower portions as a first part. By means of such means, or other similar simple means, the oil collecting and transporting ability can be further improved and secured.

Figure 5:
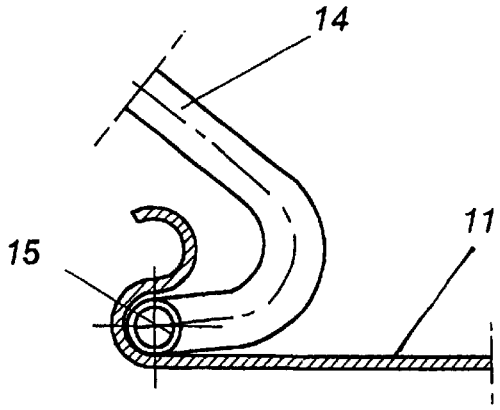
FIG. 5 shows a cross-sectional view of a modified embodiment with regard to the edge portion located adjacent to the lower part of a Pitot pipe pump included in the lubricating system.

The peripheral edge portion of the disc shaped member 11 can also advantageously be arranged in a different fashion than what has previously been described, e.g. substantially "S-shaped" as shown in FIG. 5. The Pitot pipe pump operates as an oil level controlling means, and the excess volume of oil transferred to said edge portion, apart from what is being transported further by the Pitot pipe pump, passes over the edge portion of the disc shaped member 11 and is returned to the lower oil reservoir 10 via the internal part of the compressor housing.

Figure 6:
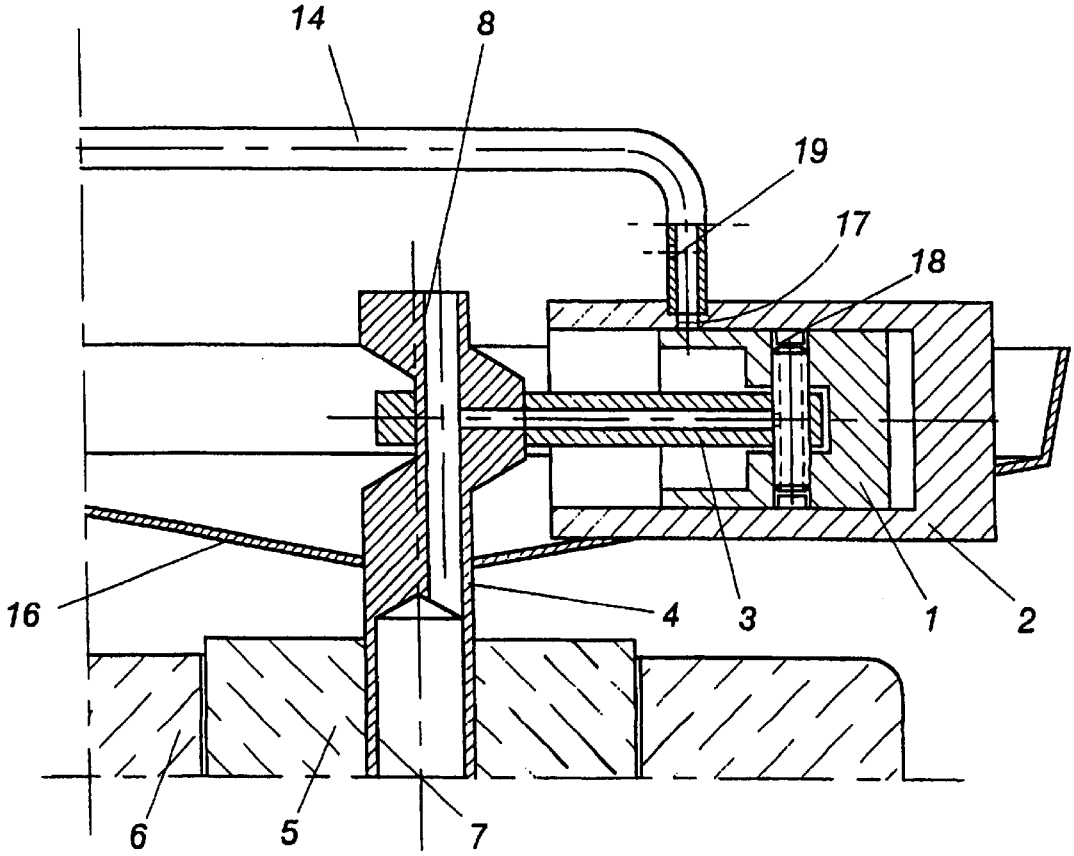
FIG. 6 shows a view substantially corresponding to the upper right portion of FIG. 1 in an enlarged scale, and discloses a modified embodiment with regard to the upper portion of the Pitot pipe pump and the piston compressor.

The lubrication of the compressor unit can also be further improved by means of the modifications shown in FIG. 6, which are made possible by supply of oil via the Pitot pipe pump. A through hole 17 is shown taken up in the upper wall of the piston cylinder 2, and the piston 1 is arranged having a surrounding groove 18, preferably located by the piston bolt. The hole 17 is located adjacent to the area where the groove 18 is located when the piston 1 is in its most adjacent position to the drive shaft 4. The upper portion of the pipe 14 forming part of the Pitot pipe pump has an opening adjacent to the hole 17, and includes a preferably sidewardly directed leakage opening 19, preferably directed towards the portion of the piston rod 3 joined to the crank.

Oil supplied through the pipe 14 fills the hole 17, from which oil is supplied to the groove 18 in the piston 1. when the hole 17 is completely filled with oil (as well as the surrounding groove 18 in the piston 1), oil supplied via the pipe 14 leaves via the leakage opening 19. During the reciprocating movement of the piston 1, the oil existing in the groove 18 causes the establishment of an oil film between the piston 1 and the piston cylinder 2, which prevents leakage of cooling media between these parts during slow operation of the compressor due to improved sealing properties, and which also increases the term of life of the piston compressor. By arranging the groove 18 located by the piston bolt of the piston 1, oil will also pass through a channel in same and lubricate the piston bolt, and should the piston rod 3 be arranged having a channel extending between piston bolt and piston rod bearing, the piston rod bearing will also be lubricated by means of the oil supplied to the groove 18.

The leakage opening 19 may also advantageously comprise of a channel taken up in the wall of the piston cylinder 2, communicating with the hole 17 in the cylinder wall. Such a channel can exit in desired location, e.g. for lubrication of the piston rod bearing or for any other desired purpose, for example, to be collected in a "leaking reservoir" rather than immediately flow down to the reservoir 10.

With regard to the example of an embodiment now described, oil transfer to the upper plane of the disc shaped member 11 is accomplished through the centrally located hole 12 by means of the conical and downwardly extending edge portion of the hole 12.

Figure 7:
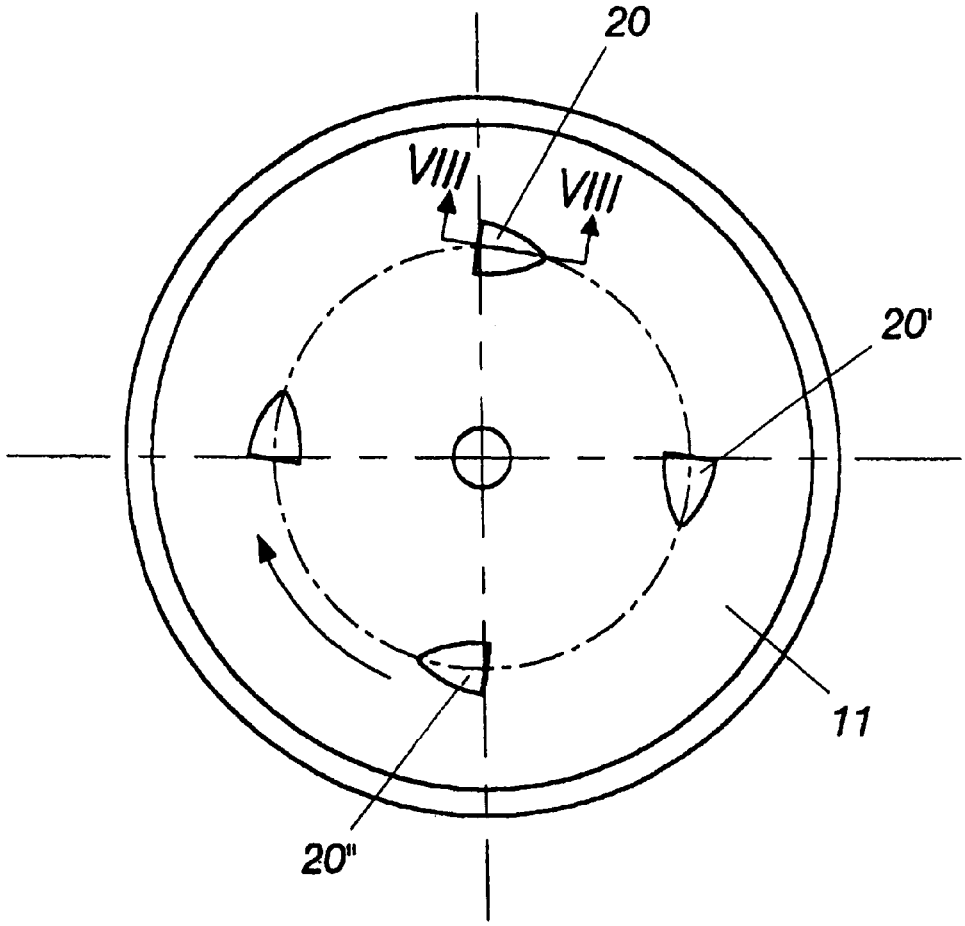
FIG. 7 is a plan view of an example of an alternative embodiment with regard to the design of an included disc-shaped member.
Figure 8:
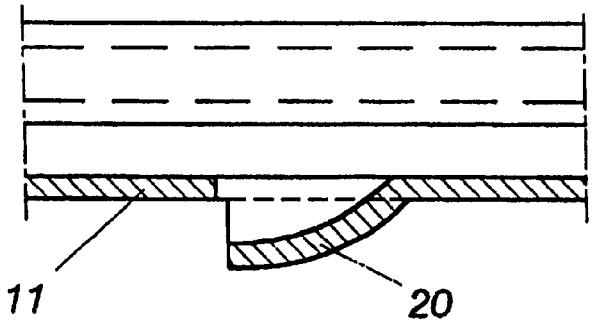
FIG. 8 shows a cross-sectional view at the line VIII—VIII in FIG. 7.

However, the disc shaped member 11 can also be arranged without such a centrally located hole 12 by utilization of other oil transferring means. An example of an embodiment of such a means is shown in FIGS. 7 and 8, comprising of a number of downwardly embossed portions 20, 20', 20" in the disc shaped member 11, having the rear part in rotary direction open. The bottom plane of the disc shaped member 11 is arranged in contact with the upper surface of the oil reservoir 10 located below, and during a fast rotary movement substantially all oil supply to the upper plane of the disc shaped member 11 is avoided, i.e. lubrication is performed in a conventional way by oil for lubrication purposes being collected and moved in direction upwards by means of the downwardly conically reduced member 9. However, at a reduced rotary speed, the downwardly embossed portions 20, 20', 20" will allow oil to reach the upper plane of the disc shaped member 11, and via the Pitot pipe pump ensure required lubrication.

Shown example of an embodiment may obviously be further modified, e.g. the downwardly embossed portions 20, 20', 20" may comprise of a number of small holes. By adapting he number and the size of utilized oil transferring means 20, 20', 20" to the rotary speed(s) intended for the operation of the compressor, i.e. with a reduced oil transferring ability at a higher rotary speed, and with an increased oil transferring ability adapted to the Pitot pipe pump at a lower rotary speed.

Figure 9:
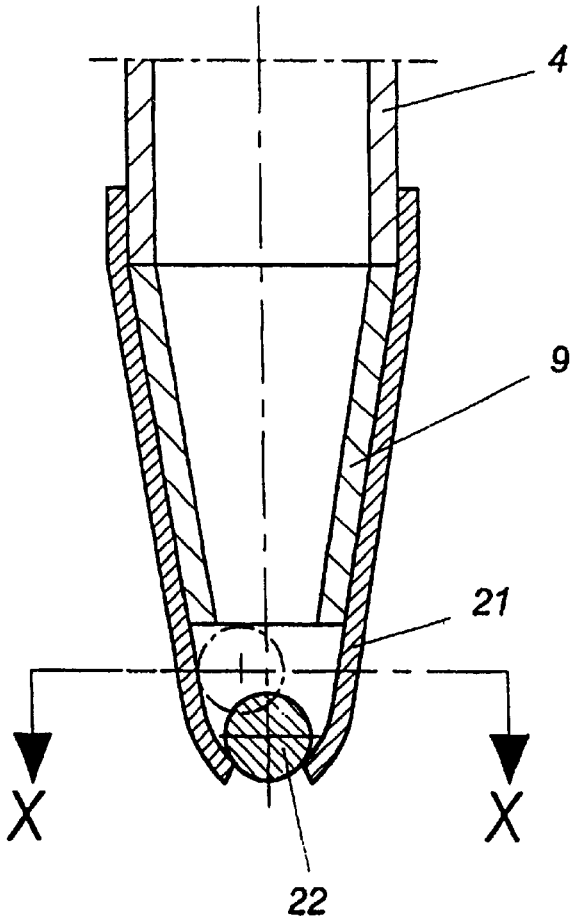
FIG. 9 shows a cross-sectional view of a modified embodiment of the lower portion of the crankshaft, including a nonreturn value shown in closed position and with the open position indicated in broken lines.
Figure 10:
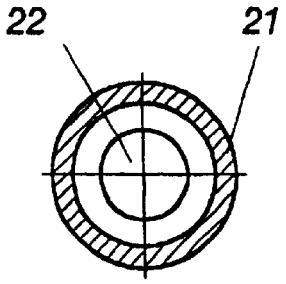
FIG. 10 shows a view at the line X—X in FIG. 9 with the nonreturn valve in closed position.

In a combined pump design intended for a higher and a lower rotary speed, lubrication accomplished from the crank of the drive shaft 4 to at least the bearing of the piston rod 3 attached to same can be secured by supplying oil from the Pitot pipe pump to the upper portion of the drive shaft 4, and by preventing same from flowing directly down to the lower oil reservoir 10 by arranging a rotary speed dependent nonreturn flow valve means. An example of an embodiment including such a nonreturn valve means is shown in FIG. 9, comprising of a conical tubular member 21, arranged surrounding previously discussed conical member 9 at the lower part of the drive shaft 4. The conical tubular member 21 has a lower opening with a diameter smaller than the diameter of an enclosed ball shaped member 22, and the lower portion of the conical tubular member 21 can thus be compared to a valve seat in which the ball shaped member acts as a valve cone at a low rotary speed. In this way, oil can be prevented from flowing into the lower oil reservoir during operation at a low rotary speed, and instead be accumulated within the holes or channels 7; 8 which are taken up within the drive shaft 4. This position is shown in FIGS. 9 and 10.

Figure 11:
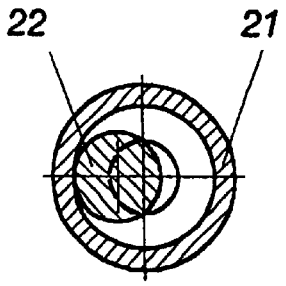
FIG. 11 shows a view corresponding to FIG. 10, but with the nonreturn valve in open position.

When the rotary speed is increased, and when lubrication is intended to be performed in previously known fashion by means of the oil transferring ability of the conical and downwardly open member 9, the ball shaped member 22 will be forced from the centrally located position due to influence from centrifugal force, which is indicated in broken lines in FIG. 9, and which is also shown in FIG. 11, whereby the known system for lubrication at a high rotary speed is operational again.

However, it should be emphasized, that shown example of an embodiment for a non-return valve means only intends to disclose the possibility of arranging such a means, since many other types of valve-acting means also advantageously can be used, and the location of such a means can also be different, e.g. for a drive shaft arrangement in which the crank member comprises of a separate part attached to the linearly extending part of the drive shaft 4, the nonreturn valve means can also be arranged at a position more closely related to the crank member, which often is regarded as an advantage.

A further problem encountered when a compressor is driven at a low speed can also be overcome without difficulties, namely that the torque required to drive the compressor varies considerably at different angular positions for the crank member during each revolution. At high rotary speeds, this problem is less noticeable since the moving mass of the motor and the compressor reduce the problem, even though required torque at the final part of a compression stroke normally exceeds the torque of the motor. At a reduced rotary speed, problems may be encountered, due to the fact that the motor does not supply required torque and the efficiency of the motor is also reduced when current increases. There is also a risk for motor vibrations and hence disturbing sound problems. According to the invention, the above mentioned problems can be eliminated by allowing the disc shaped member 11 to serve as a flywheel, which stores energy during part of each revolution, utilizing this energy during the final part of the compression phase. The ability of the disc shaped member 11 to store energy can be adjusted/increased as desired, e.g. by attaching energy storing members to the upper surface of same and/or by increasing its weight in any other suitable fashion (for example, a ring shaped solid member can easily be attached to the outer edge portion in accordance with FIG. 5). A separate flywheel can advantageously also be used, attached to a suitable point along the drive shaft 4.

The cost for an energy storing device according to the above must be set in relation to the reduced costs achieved by the reduction made possible in the costs for utilized frequency control equipment arranged to maintain a constant rotary speed for the motor. Such control equipment is based on increased current at an increased load, current being supplied from a large and expensive capacitor under control of expensive power transistors which require cooling. An embodiment including a flywheel means that the flywheel partly takes over the function of the capacitor as energy storing device and that the electronic components require reduced current. As a result, the size/cost of the capacitor becomes smaller, size and cost for the power transistors and their cooling is reduced; the term of life for the electronic components becomes increased; the motor becomes more efficient and vibrations as well as acoustic sounds are reduced.

Shown and described examples of embodiments according to the present invention can obviously be further modified. For example, the part of the lubricating system facilitating lubrication at high rotary speeds can be excluded, i.e. the conically reduced member 9 at the lower part of the drive shaft 4, with regard to applications involving only relatively low rotary speed ranges. As indicated earlier, it is also within the scope of the present invention to arrange the oil transferring means 20, 20', 20" in such a way, that they at a high rotary speed only in a minor and non-important extent supply oil to the Pitot pipe pump and thereby prevent loss of energy. For certain applications, the oil transferring ability at high/low rotary speeds can be arranged in such a way, that adequate lubrication is accomplished, without major energy loss, by means of the Pitot pipe pump only, i.e. with one and the same lubrication system intended both for the high and the low range of rotary speed.

In applications where the operation of the Pitot pipe pump should be interrupted at high rotary speed, this is preferably accomplished by lowering the oil level in the oil reservoir 10 with use of a bowl shaped "leaking reservoir" which collects excess oil, or by preventing oil from reaching the pump. It should be understood, that this can be accomplished by a person skilled in the trade in a number of ways different to what has been described.

With regard to applications in which a compressor system only is intended to operate at a low rotary speed, the drive shaft can also be manufactured substantially solid, which reduces manufacturing cost and increases the rotary mass (smoother running at low rotary speed). A channel extending from the upper portion of the drive shaft 4 can advantageously be arranged for lubrication of the piston rod bearing.

The lubricating system according to the present invention can with regard to design be arranged in a number of different ways, in order to be adapted to existing types of compressor systems. It is thus within the scope of the invention to use the lubricating system also for arrangements in which the compressor unit is arranged below the location of the motor, in which case the disc shaped member 11 is located adjacent to the underlying oil reservoir 10.

The present invention is thus in no way restricted to shown and described examples of embodiments, since same obviously can be further modified within the scope of the inventive thought and the following claims.

What is claimed is:

1. A lubricating system for smaller refrigerating machinery of piston compressor type having a substantially vertically extending drive shaft with a lower part, said system comprising:

a substantially disc shaped member arranged adjacent to the lower part of the drive shaft for rotating by a rotary movement of the drive shaft and having a substantially upwards extending peripheral edge portion and an upper plane, at least one oil transferring means for communicating with oil in an underlying oil reservoir, said at least one oil transferring means, during a rotary movement, being arranged to collect and transfer oil from the underlying oil reservoir to the upper plan of the substantially disc shaped member, a tubular pipe being arranged with its lower open part directed in an opposed direction to the rotary direction of the substantially disc shaped member and adjacent to the peripheral edge portion arranged to transfer oil as a pitot pipe pump via the tubular pipe from the substantially disc shaped member for lubrication of the piston compressor.

2. The lubricating system according to claim 1, in which the lower portion of the drive shaft comprises:

a downwardly open conically reduced tubular member extending down below the oil level in the underlying oil reservoir, at a high rotary speed and being arranged with its internal surface, due to influence from centrifugal force, to collect and transfer oil through a channel taken up in the drive shaft for lubrication of the piston compressor wherein pump action achieved by the conically reduced tubular member is arranged to lower the oil level in the underlying oil reservoir to a level at which the at least one oil transferring means no longer contacts with the oil in the underlying oil reservoir and that the oil transferring ability of said means is substantially completely reduced at high rotary speed.

3. The lubricating system according to claim 1, wherein the substantially disc shaped member comprises:

a centrally located and in direction towards the underlying oil reservoir extending conical portion, which is terminated by a hole, arranged to serve as an oil transferring means, oil penetrating through the hole being arranged under influence from centrifugal force to be moved along the conical portion to the upper plane of the substantially disc shaped member.

4. The lubricating system according to claim 1, wherein the substantially disc shaped member is arranged having oil transferring means comprising one or a number of holes arranged from the lower plane downwardly embossed portions, closed in direction against the rotary direction.

5. The lubricating system according to claim 1, wherein the substantially disc shaped member at its upper plane is arranged with one or a number of radially extending members arranged to guide existing oil in a direction towards the peripheral portion and serving as supporting members for the substantially disc shaped member having at least part of the upper parts of the radially extending members arranged bent over and extending against the rotary direction fo the substantially disc shaped member.

6. The lubricating system according to claim 1, wherein an oil collecting container is arranged at a level below the upper free portion of the pipe, communicating with the lower oil reservoir for return of excess lubricating oil.

7. The lubricating system according to claim 1, wherein the substantially disc shaped member has substantially radially extending embossments arranged to increase the speed of movement for oil existing at the upper plane of said member in a direction towards the peripheral portion.

8. The lubricating system according to claim 1, wherein the outer edge portion of the disc shaped member is arranged substantially S-shaped.

9. The lubricating system according to claim 1, wherein the substantially disc shaped member is arranged as a separate flywheel joined to the drive shaft.

10. The lubricating system according to claim 1, wherein a wall of a cylinder includes a through hole forming a part of the piston compressor, and a piston forming part of the piston compressor is arranged with a surrounding groove adjacent to the point of location for the piston bolt of the piston, the outlet of the tubular pipe arranged for communicating with said hole for a supply of oil to the groove, said hole being located adjacent to the point where the groove is located in its most adjacent position of movement in relation to the drive shaft.

11. The lubricating system according to claim 10, wherein the tubular pipe is arranged with at least one sidewardly directed leakage opening from which oil can flow when the hole is filled with oil and that a channel is taken up in the piston cylinder for this purpose.

12. The lubricating system according to claim 10, wherein the tubular pipe is arranged with at least one sidewardly directed leakage opening from which oil can flow when the hole is filled with oil.

13. The lubricating system according to claim 10, wherein the tubular pipe is arranged with channel taken up in the piston cylinder for this purpose.

14. The lubricating system according to claim 1, in which the lower portion of the drive shaft comprises:

a downwardly open conically reduced tubular member extending down below the oil level in the underlying oil reservoir, at a high rotary speed and being arranged with its internal surface, due to influence from centrifugal force, to collect and transfer oil through a channel taken up in the drive shaft for lubrication of the piston compressor wherein pump action achieved by the conically reduced tubular member is arranged to lower the oil level in the underlying oil reservoir to a level at which the oil transferring ability of said means is substantially completely reduced at high rotary speed.

15. The lubricating system according to claim 1, wherein the substantially disc shaped member is arranged as a flywheel storing rotational energy.

16. The lubricating system according to claim 1, wherein the drive shaft is arranged with a valve means arranged to prevent oil from flowing downwards within the drive shaft to the oil reservoir at a low rotary speed, and to open and remain in open position when changing to a higher rotary speed.

17. The lubricating system according to claim 1, in which the lower portion of the drive shaft comprises:

a downwardly open conically reduced tubular member extending down below the oil level in the underlying oil reservoir, at a high rotary speed and being arranged with its internal surface, due to influence from centrifugal force, to collect and transfer oil through a channel taken up in the drive shaft for lubrication of the piston compressor wherein pump action achieved by the conically reduced tubular member is arranged to lower the oil level in the underlying oil reservoir to a level at which the at least one oil transferring means no longer contacts with the oil in the underlying oil reservoir.

* * * * *